US008229127B2

(12) United States Patent
Jørgensen et al.

(10) Patent No.: US 8,229,127 B2
(45) Date of Patent: Jul. 24, 2012

(54) ACTIVE NOISE CANCELLATION IN HEARING DEVICES

(75) Inventors: Ivan Jørgensen, Smørum (DK); Karsten Bo Rasmussen, Smørum (DK); Svend Oscar Petersen, Smørum (DK)

(73) Assignee: Oticon A/S, Smorum (DK)

( * ) Notice: Subject to any disclaimer, the term of this patent is extended or adjusted under 35 U.S.C. 154(b) by 830 days.

(21) Appl. No.: 12/219,063

(22) Filed: Jul. 15, 2008

(65) Prior Publication Data

US 2009/0041260 A1 Feb. 12, 2009

(30) Foreign Application Priority Data

Aug. 10, 2007 (EP) ..... 07114152

(51) Int. Cl.
*H04R 25/00* (2006.01)

(52) U.S. Cl. ..... 381/71.6; 381/318

(58) Field of Classification Search ..... 381/71.6, 381/312, 317, 318
See application file for complete search history.

(56) References Cited

U.S. PATENT DOCUMENTS 5,991,419 A * 11/1999 Brander ..... 381/312
6,021,207 A * 2/2000 Puthuff et al. ..... 381/330
6,044,162 A * 3/2000 Mead et al. ..... 381/312
6,181,801 B1 1/2001 Puthuff et al.
6,418,227 B1 * 7/2002 Kuo ..... 381/71.11
6,445,799 B1 * 9/2002 Taenzer et al. ..... 381/71.6
6,567,524 B1 * 5/2003 Svean et al. ..... 381/71.1
6,625,286 B1 * 9/2003 Rubacha et al. ..... 381/93
6,795,557 B1 * 9/2004 Makivirta et al. ..... 381/66
6,920,227 B2 * 7/2005 Chalupper et al. ..... 381/312
7,020,297 B2 * 3/2006 Fang et al. ..... 381/317

(Continued)

FOREIGN PATENT DOCUMENTS

DE 1 033 219 7/1958

(Continued)

*Primary Examiner* — Jeremy Luks
(74) *Attorney, Agent, or Firm* — Birch, Stewart, Kolasch & Birch, LLP

(57) ABSTRACT

Disclosed is a hearing device system comprising at least one hearing aid circuitry and at least one active noise cancellation unit, the at least one hearing aid circuitry comprises at least one input transducer adapted to convert a first audio signal to an electric audio signal; a signal processor connected to the at least one input transducer and adapted to process said electric audio signal by at least partially correcting for a hearing loss of a user; an output transducer adapted to generate from at least said processed electric audio signal a sound pressure in an ear canal of the user, whereby the generated sound pressure is at least partially corrected for the hearing loss of the user; the at least one active noise cancellation unit being adapted to provide an active noise cancellation signal adapted to perform active noise cancellation of an acoustical signal entering the ear canal in addition to said generated sound pressure, wherein the hearing device system further comprises a combiner unit adapted to combine the processed electric audio signal with the active noise cancellation signal, to obtain a combined signal and to provide the combined signal to the output transducer.

19 Claims, 5 Drawing Sheets

U.S. PATENT DOCUMENTS

| | | | | |
|---|---|---|---|---|
| 7,039,195 | B1 * | 5/2006 | Svean et al. | 381/71.6 |
| 7,058,182 | B2 * | 6/2006 | Kates | 381/60 |
| 7,092,532 | B2 * | 8/2006 | Luo et al. | 381/93 |
| 2002/0076057 | A1 * | 6/2002 | Voix | 381/60 |
| 2003/0012391 | A1 * | 1/2003 | Armstrong et al. | 381/312 |
| 2004/0125973 | A1 * | 7/2004 | Fang et al. | 381/318 |
| 2005/0013456 | A1 | 1/2005 | Chalupper et al. | |
| 2006/0050911 | A1 * | 3/2006 | Von Buol | 381/321 |
| 2007/0172087 | A1 | 7/2007 | Olsen | |

FOREIGN PATENT DOCUMENTS

| | | | |
|---|---|---|---|
| EP | 0 579 152 | A1 | 1/1994 |
| WO | WO-2005/052911 | A1 | 6/2005 |
| WO | WO-2006/003618 | A1 | 1/2006 |

* cited by examiner 100
101
102
103
104
105
106
107
108
109
110
111
112
113
114
115
116

ACTIVE NOISE CANCELLATION IN HEARING DEVICES

FIELD OF THE INVENTION

This invention generally relates to a hearing device and to methods for providing a better audible signal to the user of the hearing device. More particularly, the invention relates to a hearing device comprising a hearing aid circuitry and an active noise cancellation (ANC) system. A hearing device may be such as a behind-the-ear (BTE), in-the-ear (ITE), completely-in-canal (CIC) or receiver-in-the-ear (RITE) hearing device or cochlear implant (CI).

BACKGROUND OF THE INVENTION

Previously active noise cancellation (ANC) systems and hearing aids have not been used in combination. ANC and hearing aids work in opposite ways, since a hearing aid amplifies sound and ANC attenuates sound. But by combining a hearing aid and an ANC in a suitable way as in this invention, it is possible to obtain the advantages and technical effects of both systems.

WO05052911 relates to a hearing aid which can perform active noise cancellation. The hearing aid includes a signal processor which produces a compensation/cancellation signal that can attenuate acoustic signals that bypasses the signal path of the hearing aid and enters the ear canal.

DE 1033219 also relates to a hearing aid which can perform active noise cancellation. The active noise cancellation is performed by processing signals from one or more microphones and loudspeakers arranged in the hearing aid vent. The microphone signals are transmitted to a filter unit in order to attenuate unwanted acoustic signals.

WO06003618 relates to an earplug with a circuit for active noise cancellation. When a noise signal is received in the earplug, a cancelling signal is processed by means of the circuit to cancel the noise signal.

U.S. Pat. No. 6,567,524 concerns a hearing protective earplug with an audio communication terminal for obtaining speech signals of high quality while attenuating noise. The earplug performs noise attenuation automatically adapted to the noise conditions and communication modes.

U.S. Pat. No. 6,181,801 and U.S. Pat. No. 6,021,207 relate to a communications earpiece which receives audio signals, wired and wireless, respectively, sent from an external device such as a mobile phone. Ambient sounds are used for noise cancellation. The communications earpiece can be used by both hearing impaired and non-hearing impaired users.

When a hearing device user is in a noisy environment, it is advantageous that the hearing device can perform active noise cancellation. But it is a problem of the prior art that when the hearing device operates as active noise cancellation, sound signals, both the undesired and the desired, will be attenuated due to the active noise cancellation. This may not always be desirable.

It therefore remains a problem to provide a hearing device which improves active noise cancellation (ANC) and thus may provide a better audible signal to the user.

SUMMARY

Disclosed is a hearing device system comprising at least one hearing aid circuitry and at least one active noise cancellation unit, the at least one hearing aid circuitry comprises at least one input transducer adapted to convert a first audio signal to an electric audio signal; a signal processor connected to the at least one input transducer and adapted to process said electric audio signal by at least partially correcting for a hearing loss of a user; an output transducer adapted to generate from at least said processed electric audio signal a sound pressure in an ear canal of the user, whereby the generated sound pressure is at least partially corrected for the hearing loss of the user; the at least one active noise cancellation unit being adapted to provide an active noise cancellation signal adapted to perform active noise cancellation of an acoustical signal entering the ear canal in addition to said generated sound pressure; wherein the hearing device system further comprises a combiner unit adapted to combine the processed electric audio signal with the active noise cancellation signal, to obtain a combined signal and to provide the combined signal to the output transducer.

Consequently, it is an advantage that the processed electric audio signal is combined with the active noise cancellation signal, since by providing the combined signal to the output transducer, all noise signals that have entered the ear canal by either a hearing device vent, by leakage between the hearing device and the ear canal wall, through an input transducer etc. will be cancelled or reduced.

The interference between the noise signals that have entered the ear canal and the cancellation signal in the combined signal occurs in the residual space defined between the hearing device in the ear canal and the tympanic membrane.

It is an advantage that all undesired sound signals will be attenuated, when the active noise cancellation (ANC) system is active.

Typically, a hearing device vent channel is included in hearing devices for user comfort, since a vent enables sound pressure equalization between the ambient space surrounding the hearing device user and the residual space in the ear canal, at low frequencies. But the vent allows sound signals from the surroundings to enter into the ear canal even when the hearing aid circuitry is turned off, and this may be very unpleasant and annoying for the user.

In the hearing device of the present invention the ANC system may attenuate sound signals constantly, even when the hearing aid functionality is turned off, and therefore the user may avoid noise from all undesired sound signals.

Traditionally, if a hearing aid circuitry is operated as an ANC, the hearing aid circuitry will consequently reduce, attenuate or block out audio signals. The user of the hearing device may therefore loose desired audio signals, since they may be attenuated as the undesired audio signals. Therefore it is an advantage of the present invention that the hearing device may comprise both a hearing aid circuitry with hearing aid functionality and an ANC system with noise cancelling abilities.

A further advantage of using both ANC and a hearing aid circuitry is that noise contributions from a specific frequency range may be reduced. A conventional hearing aid circuitry can not reduce acoustic signals more than what is achieved by turning off the amplification in a particular frequency band. But when combining a hearing aid circuitry and an ANC system, the ANC makes it possible to reduce the amplification to an even lower level or lower response than the "occluded" response, which is the sound pressure level in the residual space, when at least a part of the hearing device is inserted into the ear canal and the gain turned off.

An example to illustrate this: if in the occluded response the frequency range from 700 to 1100 Hz is dominated by a noise signal of 80 dB SPL (sound pressure level), and the frequency range above 1100 Hz is dominated by a desired signal, i.e. speech, at 60 dB SPL, then a conventional hearing device would need to amplify the signals above 1100 Hz with 30 dB to get 10 dB SNR (signal-to-noise ratio). If the ANC reduced the direct sound by 15 dB, then the occluded response from 700 to 1100 Hz would be 65 dB SPL, and then the hearing device would only need to amplify the bands above 1100 Hz with 15 dB gain instead of 30 dB gain to get 10 dB SNR. Or alternatively if the hearing device amplifies 30 dB, then the SNR becomes 25 dB. Additionally, an improved dynamic range is achieved, since the dynamic range is the ratio between noise and the most powerful signal.

In one embodiment the hearing device system may further comprises an audio streaming control unit adapted to receive, and optionally process, a second audio signal from an audio streaming device. Alternatively, the hearing device system may comprise an audio streaming device for generating the second audio signal.

Consequently, it is an advantage that the hearing device system may comprise both a hearing aid circuitry, active noise cancellation and means for receiving an audio signal from an audio streaming device. Noise, such as background noise from e.g. cars, aircrafts etc, can be a problem to hearing device users. When a user is in a noisy environment, the hearing device may perform active noise cancellation, and at the same time it may be advantageous for the user to listen to music, radio etc from the audio streaming device. In some embodiments, the combiner unit may thus further be adapted to combine the, optionally processed, second audio signal with the active noise cancellation signal.

The noise cancellation performed by the ANC system will together with the streamed audio signal result in an improved signal-to-noise ratio (SNR) for the user, since unwanted audio noise will be cancelled or reduced while a desired audio signal is streamed directly to the output transducer(s), e.g. loud speaker(s), in the ear canal(s) of the user.

The audio streaming device may be such as a radio transmission, a music player such as a MP3 player, a mobile phone, audio transmission from a TV and/or the like.

The audio streaming device may e.g. be wirelessly connected or wire-connected to the hearing device.

The hearing aid circuitry may be fully functional when the ANC system is active. The hearing aid circuitry may also be in a condition where the audio streaming device transmits audio signals to the hearing device, so that the user can listen to e.g. music.

The user may choose to listen to e.g. music when there is much noise in the surroundings, but the user may also choose to listen to music, radio, TV etc. even though there is not any noise in the surroundings. It is understood that the audio streaming device may be used for any purpose at any time, e.g. listening to music, mobile phone usage etc.

Furthermore, it is understood that the hearing device may be used by hearing impaired users and/or non-hearing impaired users. If the hearing device is used by a hearing impaired user, the signal processor is adapted to process all received audio signals, both from the input transducer(s) and from the audio streaming device, according to the user's hearing loss. In addition to this, the ANC system will cancel noise from the surroundings.

Applications for hearing-impaired users may be:

hearing aid circuitry and ANC, hearing aid circuitry, ANC and audio streaming device in order to improve SNR.

If the hearing device is used by a non-hearing impaired user, the ANC system will cancel noise from the surroundings, and the user may use the audio streaming device for mobile phone usage, listening to music, radio etc.

Applications for non-hearing impaired users may be:

ANC,

ANC and audio streaming, security personal, headset(s) in the ear(s), for people in noisy environment, In one embodiment a hearing device system is disclosed wherein the at least one active noise cancellation unit may be analogue.

An advantage of this embodiment is that the analogue ANC will cancel, reduce or attenuate the direct sound, which is the sound through the hearing device vent and possible leakage between the ear mould and the ear canal, and this will result in a reduced comb filter effect. The comb filter effect occurs when a delayed version of a signal is added to the signal itself, which causes constructive and destructive interference. The comb filter effect occurs in digital hearing devices, because the delay through the digital hearing device processing path and the direct sound through the vent will result in acoustic interference, since some frequencies are cancelled out due to same level and opposite phase of direct sound through the vent and the delayed sound through the digital hearing device.

Another way to solve the problem of the comb filter effect would be by reducing the vent size, but a side effect of reducing the vent size is that occlusion is increased. When the hearing device user speaks there will be a build-up of low frequency sound conducted via the skull and head tissue to the residual space in the ear canal behind the hearing device. This build-up of sound produces the so-called occlusion effect.

So by using the effect of the ANC to reduce the direct sound though the vent and thereby reducing the comb filter effect, reduction of vent size may not be necessary and occlusion may thereby be avoided.

Furthermore, if a digital hearing aid circuitry is operated as an ANC system, the delay through the electronics should be very low due to the sound parsed through the vent, because the delay in the signal processing should be comparable with the delay of sound entering through the vent in order for the noise cancellation to take place. In an analogue ANC system there is a low delay, which is an advantage for achieving a well-functioning ANC system. So by having an analogue signal path as in this embodiment, the delay will be low.

In some embodiments the hearing device system may further comprise a digital feed-back cancellation unit. In one embodiment, the digital feedback cancellation unit is adapted to adjust gain in the active noise cancellation filter.

The gain in the ANC filter may need to be adjusted according to the openness, vent size and/or leakage ("effective vent") of the individual hearing device in a specific ear, and these parameters can be dynamically changing. The digital feed-back cancellation (DFC) is a dynamic system that continuously estimates the feed-back path of the hearing aid circuitry, which is the transfer function through the output transducer into the vent, out of the vent and through the input transducer.

An advantage of this embodiment is that the transfer function contains information about how open the vent is and may therefore be used to update the gain of the ANC filter.

This application may be used for ANC systems like analogue feed-forward ANC systems, analogue feed-back ANC systems, digital feed-forward ANC systems, digital feed-back ANC systems and/or combinations thereof.

In one embodiment a hearing device system is disclosed which further may comprise a digital feed-back cancellation unit adapted to adjust the filter characteristics of the active noise cancellation filter.

An advantage of this embodiment is that the filter characteristics, such as frequency response, of the ANC filter may be adjusted according to the DFC. This application may also be used for ANC systems like analogue feed-forward ANC systems, analogue feed-back ANC systems, digital feed-forward ANC systems, digital feed-back ANC systems and/or combinations thereof.

Typically, in conventional hearing devices an adaptive and adjustable system is obtained by implementing an extra microphone, a so called error microphone, which can receive and communicate "error signals" in the hearing device. By implementing a DFC system, which may adjust and adapt gain and/or filter characteristics in the ANC filter, an error microphone in the hearing device may be omitted.

It is to be understood that any suitable kind of acoustical feedback path estimator may be implemented in order to obtain the feedback estimation and cancellation.

In one embodiment the hearing device system may further comprise an output automatic gain control (AGC) unit. In a conventional hearing aid the vent limits how powerful the sound pressures generated by the output transducer may be at low frequencies. The maximum output from the output transducer will easily be reached at low frequencies, e.g. 90-95 dB at 200 Hz and 100-115 dB at 1 kHz. Consequently, it is an advantage of this embodiment that by implementing an AGC in the hearing device, it may be ensured that the output transducer does not cut at powerful sound pressures in the low frequency region, and at the same time a high dynamic region is retained at high frequencies.

In one embodiment the hearing device system may further comprise a pulse width modulation unit adapted to perform pulse width modulation of the combined signal.

In one embodiment the hearing device system may further comprise a pulse density modulation unit adapted to perform pulse density modulation of the processed electric audio signal.

An advantage of these embodiments is that pulse width modulated signals and pulse density modulated signals allow the exploitation the benefits of class C/D operation, thus providing increased efficiency and low power consumption.

Further embodiments are disclosed in the dependent claims.

According to one aspect a method of improving noise cancellation in a hearing device system, the method comprising the steps of converting a first audio signal to an electric audio signal by an input transducer; processing the electric audio signal by at least partially correcting for a hearing loss of the user by a signal processor; generating from at least said processed electric audio signal a sound pressure in an ear canal of the user by an output transducer, whereby the generated sound pressure is at least partially corrected for the hearing loss of the user; providing an active noise cancellation signal adapted to perform active noise cancellation of an acoustical signal entering the ear canal in addition to said generated sound pressure by at least one active noise cancellation unit; wherein the method further comprises the step of combining the processed electric audio signal with the active noise cancellation signal by a combiner unit to obtain a combined signal and providing the combined signal to the output transducer.

The present invention relates to different aspects including the hearing device described above and in the following, and corresponding methods, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawing, wherein.

DETAILED DESCRIPTION

In the following description, reference is made to the accompanying figures, which show by way of illustration how the invention may be practiced.

Figure 1:
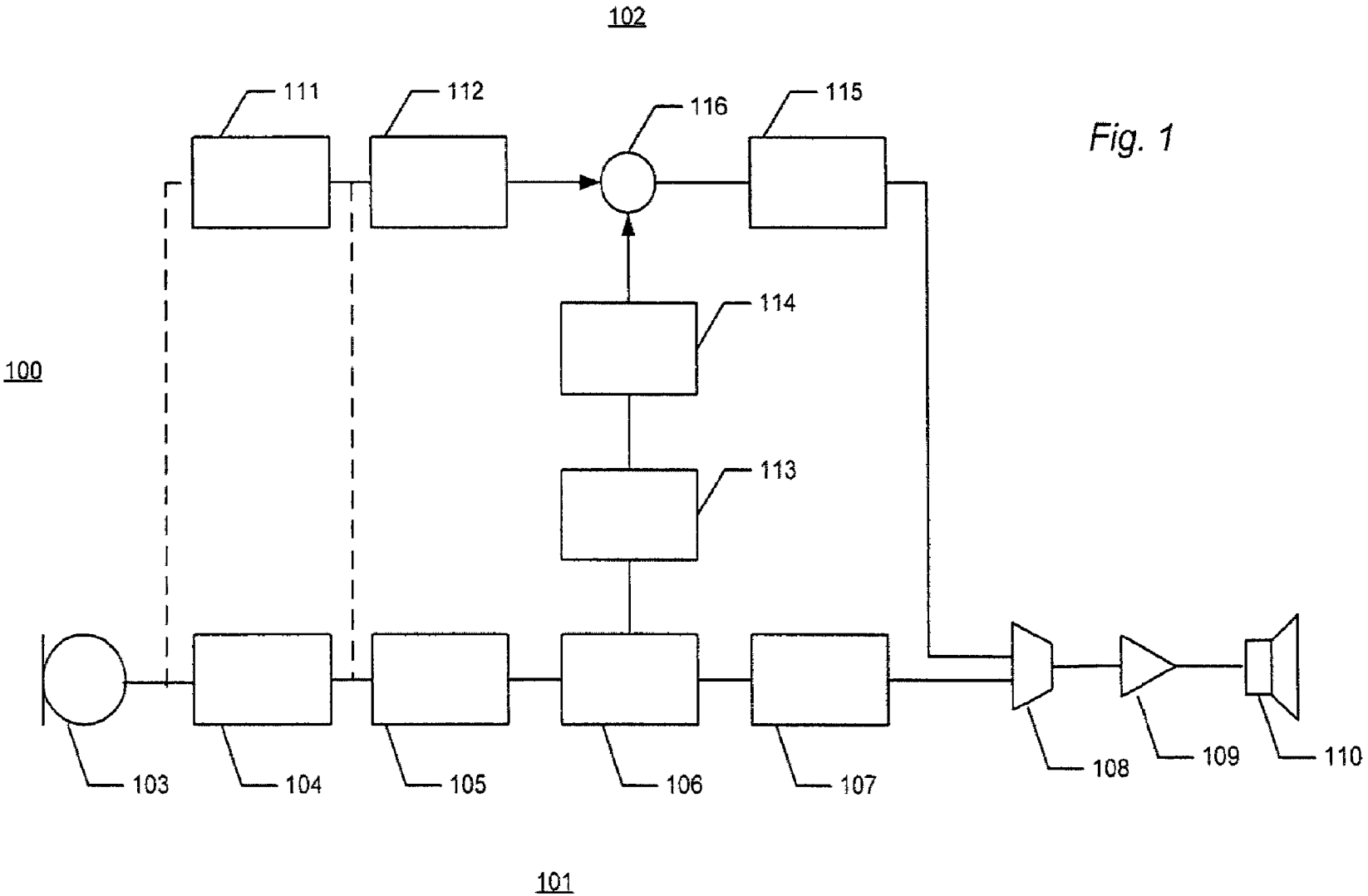
FIG. 1 shows a schematic view of a hearing device.

FIG. 1 shows a hearing device 100 combining a digital hearing aid circuitry 101 and an analogue ANC system 102.

The hearing aid circuitry part 101 comprises a signal path comprising one input transducer 103, e.g. a microphone, which points towards the ambient space surrounding the hearing device user and which converts an ambient sound entering the ear of the user from the ambient space to an electric signal. Even though one input transducer is shown in the figure, it is understood that there can be more than one input transducer and more than one signal path.

The electric signal is communicated to a gain stage (G1) 104 in which the electric signal is amplified. From the gain stage (G1) 104 the signal is communicated to an analogue-to-digital (A/D) converter 105, which converts the amplified analogue electric signal to a digital signal. The digital electric signal is communicated to a digital signal processing (DSP) unit 106 being adapted to process the digital electric signal in accordance with a desired correction of the hearing loss specific for the user of the hearing device. The digital electric signal is communicated to a digital-to-analogue (D/A) converter 107, which converts the digital electric signal to an analogue pulse density modulated (PDM) electric signal. The analogue electric signal is communicated to a multiplexer 108, and then to a low output impedance output driver 109. Finally the analogue PDM electric signal is communicated to an output transducer 110, e.g. a loudspeaker, which converts the electric signal to a sound pressure signal affecting the tympanic membrane in the residual space (not shown).

The active noise cancellation (ANC) system, which is part 102 of the hearing device 100, comprises an analogue signal path that is implemented in parallel of the hearing aid circuitry input transducer (microphone) channel. The ANC system may have its own input transducer(s) and output transducer, but in a hearing device application the existing input transducer(s) 103 and output transducer 110 may be reused.

A first analogue signal path comprises a gain stage (G2) 111 and an ANC unit 112, which can be configured to perform active noise cancellation by means of an ANC filter. This first signal path provides a first signal. Even though two gain stages, 104 and 111 are shown in FIG. 1, it is understood that gain stage 104 in the hearing aid circuitry microphone channel, part 101, may be reused in the ANC system, part 102, and hence only one gain stage may be needed, as indicated by the dashed lines in FIG. 1.

The ANC filter unit is configured to provide active noise cancellation of the noise from the surroundings. Noise may be unwanted audio signals which disturb the hearing device user. The analogue system has the advantage of an extremely low delay, which is essential to a well functioning ANC system.

In one embodiment the ANC system can be a feed-forward type, where the noise cancellation is based on a signal from an external input transducer, e.g. a microphone. The external input transducer may e.g. be the input transducer 103 in FIG. 1 and/or it may be a second input transducer positioned close to the vent opening pointing towards the ambient space surrounding the hearing device user.

In another embodiment the ANC system may be a feedback type, where the noise cancellation signal is based on an internal input transducer, e.g. a microphone, sensing the sound experienced by the hearing device user. The internal input transducer may e.g. be placed in the end of the hearing device pointing towards the residual space in the ear canal.

In a third embodiment the ANC system may be a combination of a feed-forward type and a feed-back type.

A second signal path comprises a digital-to-analogue (D/A) converter 113 and an anti-aliasing filter 114 to convert a digital signal from the DSP 106 to an analogue signal.

In one embodiment a digital signal may be streamed/communicated from an external device (not shown) through the DSP 106 into the signal path 102. The external audio streaming device may be e.g. a directional microphone array, a TV connection, a mobile phone, a radio, a music player such as an MP3 etc. streaming an audio signal.

The external audio streaming device may be wire-connected or wirelessly connected to the hearing device e.g. by means of point-to-point communication, broadcasting, cellular networks and/or other wireless network.

The audio signal from the external device may be streamed, when the hearing device user is e.g. in a noisy environment, such as near cars, aircrafts etc. and the user therefore wishes to listen to e.g. music or radio instead of hearing noise in the hearing device.

The ANC system may cancel or reduce the surrounding noise, while the streamed signal from the external device may be processed through the DSP 106 of the hearing aid circuitry part 101 in order to correct or compensate for any hearing loss that the user may have. The function of the ANC system together with the streamed signal will result in an improved signal-to-noise ratio (SNR), since unwanted audio noise will be cancelled or reduced while a desired audio signal is streamed directly to the output transducer 110 of the hearing device 100.

Since the same DSP unit 106 may be used for correcting all input signals in the hearing device, both from the input transducer 103 and from the external device, only one DSP unit is needed.

In another embodiment the streamed signal may be processed in the external device before being transmitted to the hearing device 100, and then the external device will therefore have to be configured for a specific hearing loss.

The ANC signal and the processed, hearing loss corrected signal are then combined at the combiner unit 116 before being fed to a pulse width modulation (PWM) stage 115, or a stage that provides the analogue signal with low output impedance, whereby the signal may be communicated to the output transducer 110 directly. The PWM stage has low delay and high power efficiency.

In the hearing aid circuitry part 101 of the hearing device 100 the output transducer 110 is driven using a pulse density modulated signal, and in the ANC system the signal is pulse width modulated in the PWM stage 115. Pulse width modulated and pulse density modulated signals have the benefit of allowing class C/D operation in the output stage, thereby providing high efficiency and low power consumption.

Since both signals, from signal path 101 and 102, therefore are present as a pulse modulated signal ("1-bit signal"), they may share the output driver (amplifier) 109, described above. By using the multiplexer 108 it is possible to switch between the two signal paths. Alternatively, the system may be constructed in a way where the two paths 101 and 102 have separate drivers or where the PWM stage (115) drives the output transducer 110 directly.

The digital hearing aid circuitry 101 may be fully functional when the ANC system 102 is active, or it may be in a condition where the audio signal comes from an external device (not shown), e.g. an audio streaming device, such as a radio, an MP3 music player or from external microphones.

Even though the figure shows a digital hearing aid circuitry and an analogue ANC system, it is understood that the hearing aid circuitry may be analogue and/or that the ANC system may be digital.

Figure 2:
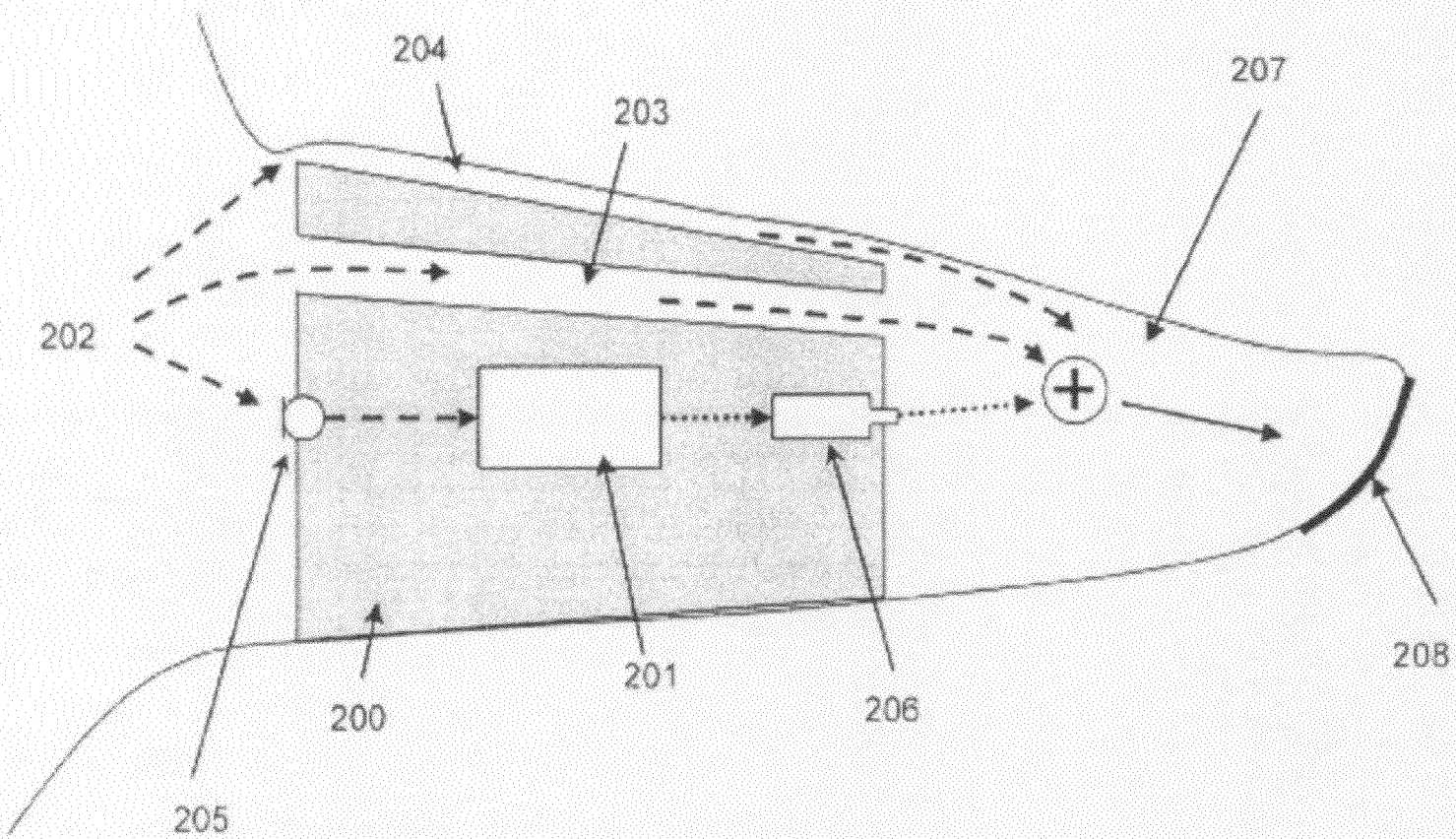
FIG. 2 shows a schematic view of feed-forward active noise cancellation in a hearing device.

FIG. 2 shows a hearing device 200 performing feed-forward active noise cancellation (ANC) by means of an ANC unit 201.

External noise signals 202 may enter the ear canal through the vent 203 and/or by means of leakage 204 between the hearing device and the ear canal wall. The noise signals may also be detected by an external input transducer 205. It is understood that there may be one or more external input transducers 205. The external input transducer(s) 205 may be the conventional hearing aid circuitry input transducer(s) and/or dedicated ANC input transducer(s) placed e.g. on the external side of the hearing device, i.e. pointing towards the surroundings.

The ANC unit 201 filters the audio signal communicated from the input transducer 205. When the audio signal is converted to sound by means of an output transducer 206, this sound signal will interfere with the noise signals from the noise signal paths, that entered the ear canal though the vent 203 and/or by means of leakage 204, and this will result in a cancelled or reduced sound pressure in the residual space 207 of the ear canal between the hearing device 200 and at the tympanic membrane 208.

The ANC unit may be analogue or digital or a combination of both. The output transducer 206 may be the conventional hearing device output transducer or it may be a dedicated ANC output transducer. Even though only one output transducer 206 is shown in the figure, it is understood that there may be one or more output transducers in the hearing device.

Figure 3:
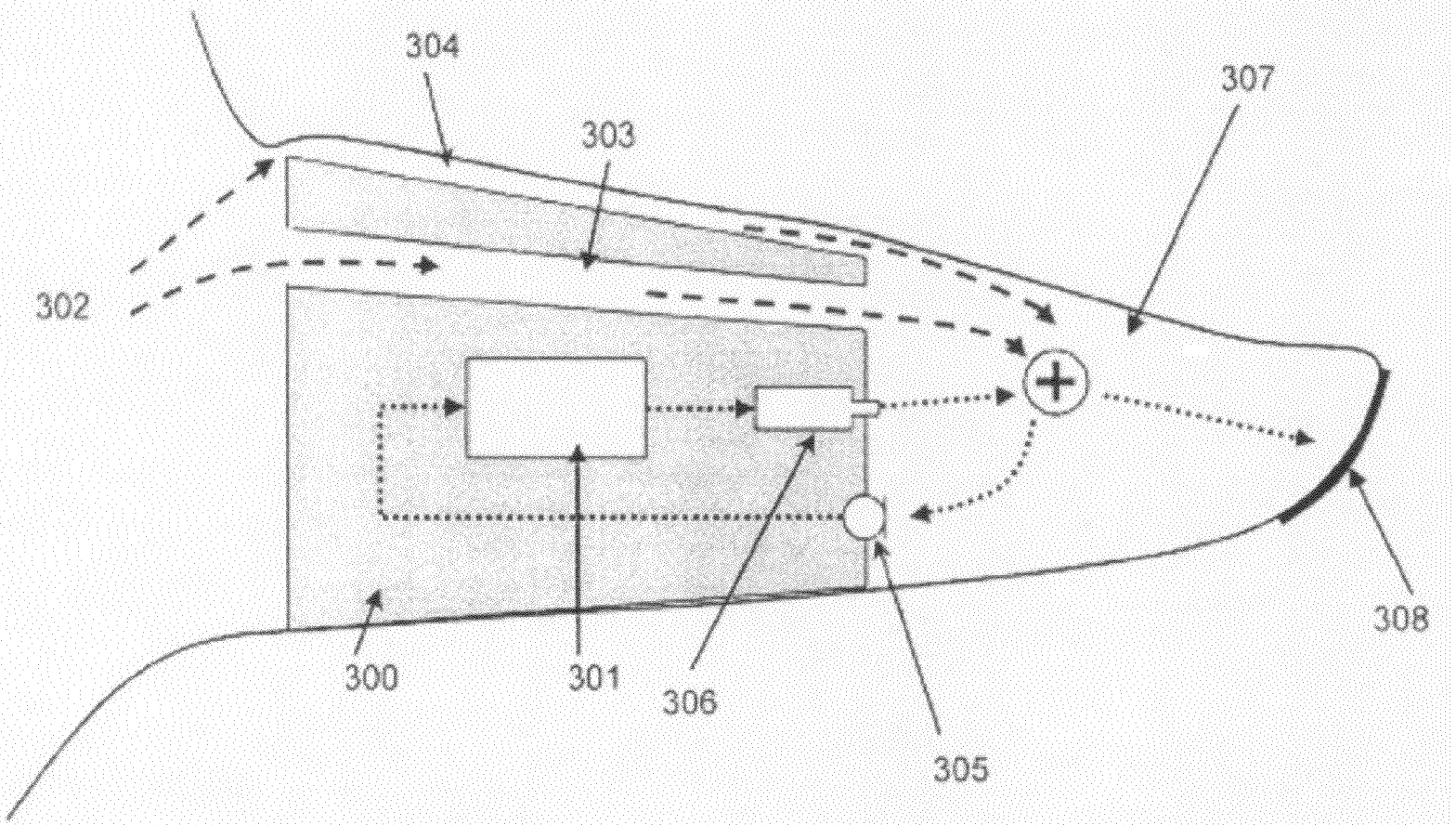
FIG. 3 shows a schematic view of feed-back active noise cancellation in a hearing device.

FIG. 3 shows a hearing device 300 performing feedback active noise cancellation by means of an ANC unit 301.

External noise signals 302 may enter the ear canal through the vent 303 and/or by means of leakage 304 between the hearing device and the ear canal wall. The noise signals may be detected in the ear by an internal input transducer 305. It is understood that there may be one or more internal input transducers 305.

The ANC unit 301 filters the audio signal communicated from the internal input transducer 305. When the audio signal is converted to sound by means of an output transducer 306, this sound signal will interfere with the noise signals from the signal paths, that entered the ear canal through the vent 303 and/or by means of leakage 304, and this will result in a cancelled or reduced sound pressure in the residual space 307 of the ear canal between the hearing device 300 and at the tympanic membrane 308.

The ANC unit may be analogue or digital or a combination of both. The output transducer 306 may be the conventional hearing device output transducer or it may be a dedicated ANC output transducer. Even though only one output transducer 306 is shown in the figure, it is understood that there may be one or more output transducers in the hearing device.

Figure 4:
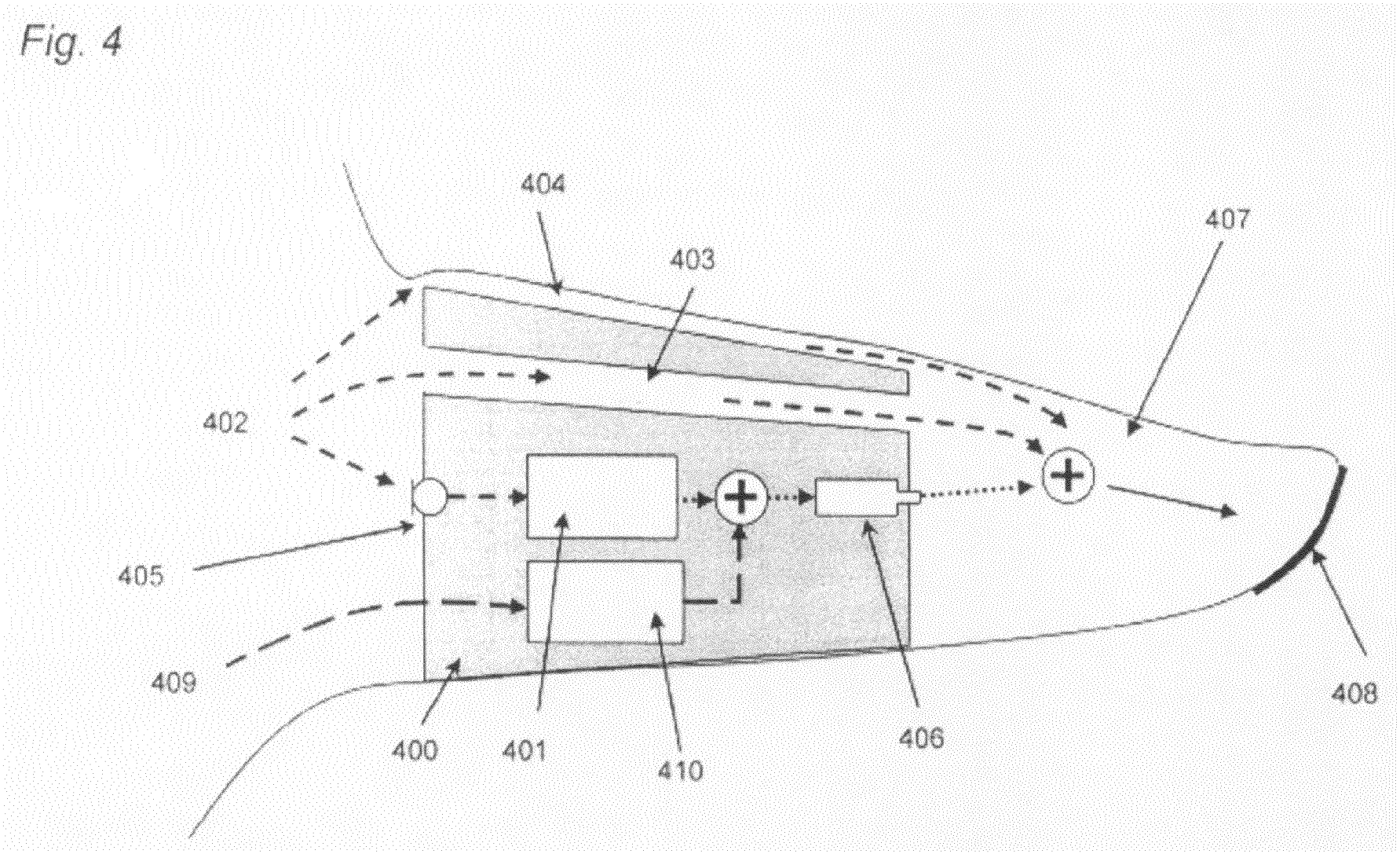
FIG. 4 shows a schematic view of active noise cancellation and audio streaming in a hearing device.

FIG. 4 shows a hearing device 400 with active noise cancellation and streaming of audio signals 409.

The hearing device 400 performs feed-forward active noise cancellation (ANC) by means of an ANC unit 401.

External noise signals 402 may enter the ear canal through the vent 403 and/or by means of leakage 404 between the hearing device and the ear canal wall. The noise signals may also be detected by an external input transducer 405. It is understood that there may be one or more external input transducers 405. The external input transducer(s) 405 may be the conventional hearing aid circuitry input transducer(s) and/or dedicated ANC input transducer(s) placed e.g. on the external side of the hearing device.

The ANC unit 401 filters the audio signal communicated from the input transducer 405. When the audio signal is converted to sound by means of an output transducer 406, this sound signal will interfere with the noise signals, that entered the ear canal though the vent 403 and/or by means of leakage 404, and this will result in a cancelled or reduced sound pressure in the residual space 407 of the ear canal between the hearing device 400 and at the tympanic membrane 408.

The ANC unit may be analogue or digital or a combination of both. The output transducer 406 may be the conventional hearing device output transducer or it may be a dedicated ANC output transducer. Even though only one output transducer 406 is shown in the figure, it is understood that there may be one or more output transducers in the hearing device.

The streamed audio signal 409 may be received in any other way than acoustical in order to ensure that only acoustical signals, i.e. the external acoustical noise signals 402, is cancelled or reduced and that the streamed audio signal 409 remains in the residual space of the ear canal 407.

The streaming may via a direct audio input (DAI), telecoil, RF etc., and it may be analogue or digital, e.g. nearlink or bluetooth.

The controller unit 410 receives the streamed signal 409 and performs signal processing of it, i.e. filtering, gain, correction etc. before communicating it to the output transducer 406. For example, the controller unit may be implemented as a part of DSP 106 shown in FIG. 1 or as a separate unit feeding its output signal via DSP 106 to the combiner unit 116 of FIG. 1.

Even though the figure shows a feed-forward ANC system, it is understood that the system may be implemented in a feedback ANC system. In a feedback system, the streamed signal could be detected by an internal feedback microphone and thereby attenuated. However, this could be accounted for in the control unit 410.

Figure 5:
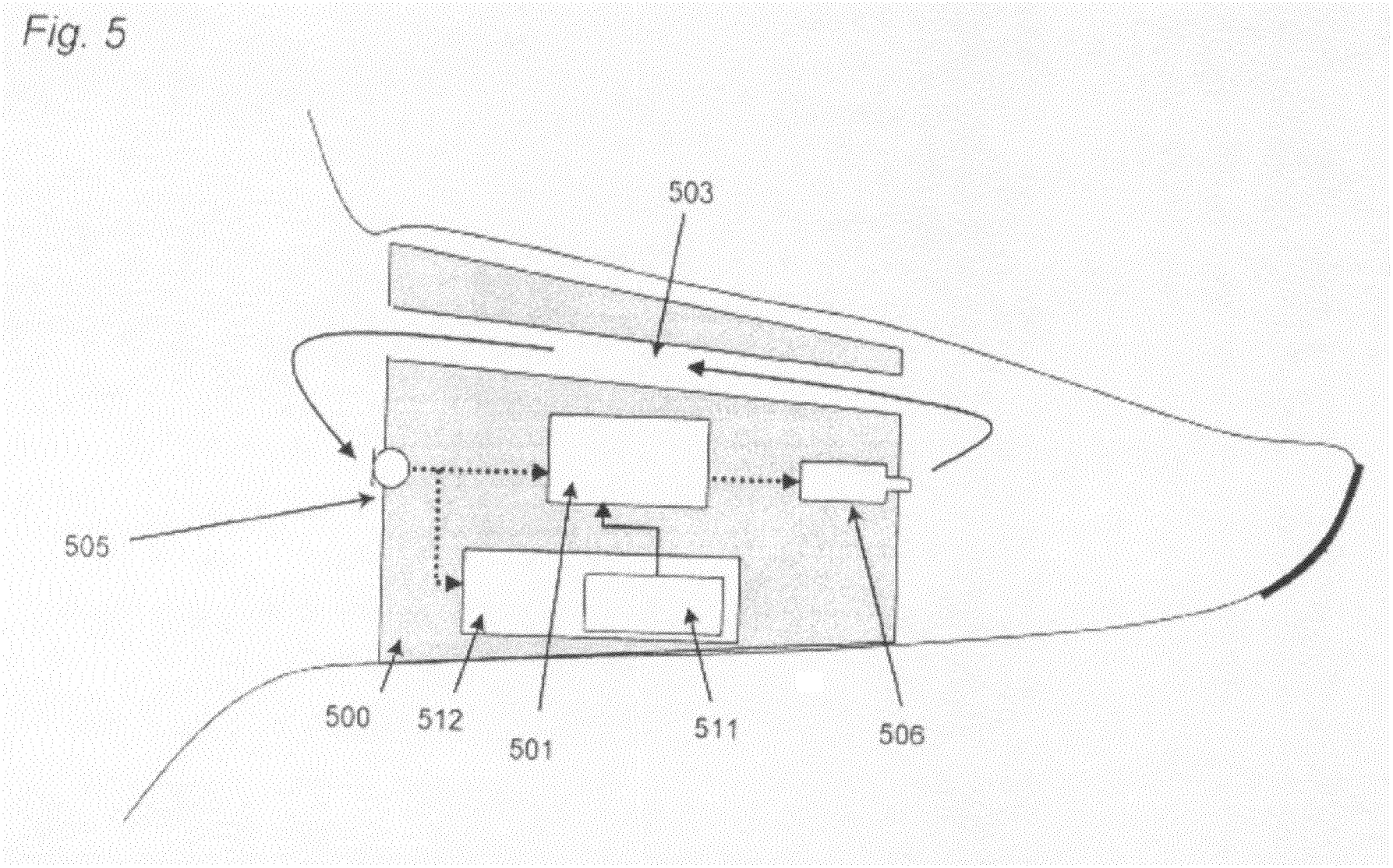
FIG. 5 shows a schematic view of digital feed-back cancellation in a hearing device.

FIG. 5 shows a hearing device 500 with a digital feedback cancellation (DFC) system 511. Information from the DFC system 511 may be used to optimize or adjust the ANC filter unit 501. The DFC system 511 may be a part of the digital signal processing unit 512 in a digital hearing aid circuitry, e.g. DSP 106 shown in FIG. 1, and is used for detection and suppression of howling caused by acoustical feedback. The DFC continuously estimates the acoustical feedback path, which is the transfer function of the output transducer 506 in the ear, the vent 503 and the external input transducer 505. Information from this transfer function may be used to adjust the gain and the frequency response of the ANC filter for optimal ANC performance.

All embodiments shown in the figures and described above may apply for both in-the-ear hearing device styles (e.g. ITE, CIC, ITC, MIC etc), behind-the-ear hearing device styles (BTE) and receiver-in-the-ear hearing device styles (RITE). For the BTE and the RITE styles, the input transducer, e.g. microphone, may be placed behind the ear like the conventional microphone location for the particular styles in a feed-forward ANC setup, or the microphone may be placed in the ear, like the position of an ITE hearing device microphone.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

In device claims enumerating several means, several of these means may be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A hearing device system, comprising:

at least one hearing aid circuitry including at least one input transducer adapted to convert a first audio signal to an electric audio signal, a signal processor connected to the at least one input transducer and configured to process said electric audio signal by at least partially correcting for a hearing loss of a user, thereby generating a processed electric audio signal, and an output transducer configured to generate from at least said processed electric audio signal a sound pressure in an ear canal of the user, wherein the generated sound pressure is at least partially corrected for the hearing loss of the user;

at least one active noise cancellation unit configured to cancel an acoustic signal bypassing the hearing device positioned in the ear canal by providing an active noise cancellation signal, the at least one active noise cancellation unit including an active noise cancellation filter;

a feed-back cancellation unit configured to estimate an acoustical feedback path from the output transducer to the at least one input transducer and to adjust filter characteristics of the active noise cancellation filter in the at least one active noise cancellation unit; and a combiner unit configured to combine the processed electric audio signal with the active noise cancellation signal, to obtain a combined signal and to provide the combined signal to the output transducer.

2. A hearing device system according to claim 1, wherein the hearing device system further comprises an audio streaming control unit adapted to receive a second audio signal from an audio streaming device.

3. A hearing device system according to claim 2, wherein the combiner unit is further adapted to combine the second audio signal with the active noise cancellation signal, to obtain a combined signal and to provide the combined signal to the output transducer.

4. A hearing device system according to claim 1, wherein the at least one active noise cancellation unit further comprises an output automatic gain control.

5. A hearing device system according to claim 1, wherein the hearing device system further comprises a pulse width modulation unit adapted to perform pulse width modulation of the combined signal.

6. A hearing device system according to claim 1, wherein the hearing device system further comprises a pulse density modulation unit adapted to perform pulse density modulation of the processed electric audio signal.

7. A hearing device system according to claim 1, wherein the at least one active noise cancellation unit is analogue.

8. A hearing device system according to claim 1, wherein the at least one active noise cancellation unit is digital.

9. A hearing device system according to claim 2, wherein the audio streaming device is digital.

10. A hearing device system according to claim 2, wherein the audio streaming device is analogue.

11. A hearing device system according to claim 1, wherein the at least one active noise cancellation unit is a feed-forward type active noise cancellation unit, where noise cancellation is based on a signal from the at least one input transducer.

12. A hearing device system according to claim 1, wherein the at least one active noise cancellation unit is a feedback type active noise cancellation unit, where noise cancellation is based on a second input transducer adapted to convert a second audio signal from residual space.

13. A hearing device system according to claim 1, wherein the at least one active noise cancellation unit is a combination of feed-forward-type and feedback type active noise cancellation unit.

14. A hearing device system according to claim 2, wherein the hearing device system is wirelessly connectable to the audio streaming device.

15. A hearing device system according to claim 2, wherein the hearing device system is wire-connectable to the audio streaming device.

16. The hearing device system according to claim 1, further comprising:

a second input transducer configured to convert a second audio signal to a second electric audio signal, the second input transducer having directional sensitivity pointed toward ambient space surrounding the hearing device, wherein the at least one active noise cancellation unit is configured to perform active noise cancellation based on the second electric audio signal.

17. The hearing device system according to claim 1, wherein the acoustic signal bypassing the hearing device passes through a void between the hearing device and a wall of the ear canal.

18. The hearing device system according to claim 1, wherein the acoustic signal bypassing the hearing device passes through a vent of the hearing device.

19. A method of improving noise cancellation in a hearing device system, comprising:

converting a first audio signal to an electric audio signal by an input transducer;

processing the electric audio signal by at least partially correcting for a hearing loss of a user by a signal processor;

generating from at least said processed electric audio signal a sound pressure in an ear canal of the user by an output transducer, wherein the generated sound pressure is at least partially corrected for the hearing loss of the user;

providing an active noise cancellation signal adapted to perform active noise cancellation of an acoustical signal bypassing the hearing device positioned in the ear canal of the user by at least one active noise cancellation unit including an active noise cancellation filter;

estimating an acoustical feedback path from the output transducer to the input transducer by a feed-back cancellation unit;

adjusting filter characteristics of the active noise cancellation filter in the at least one active noise cancellation unit by the feed-back cancellation unit; and combining the processed electric audio signal with the active noise cancellation signal by a combiner unit to obtain a combined signal and providing the combined signal to the output transducer.

* * * * *